US006935032B2

(12) United States Patent
Follo

(10) Patent No.: US 6,935,032 B2
(45) Date of Patent: Aug. 30, 2005

(54) RAZOR CARTRIDGE

(75) Inventor: Thomas A. Follo, Milford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 86 days.

(21) Appl. No.: 10/352,447

(22) Filed: Jan. 28, 2003

(65) Prior Publication Data

US 2003/0217472 A1 Nov. 27, 2003

Related U.S. Application Data

(60) Provisional application No. 60/352,805, filed on Jan. 30, 2002.

(51) Int. Cl.[7] ..... B26B 21/30; B26B 21/22

(52) U.S. Cl. ..... 30/531; 30/79

(58) Field of Search ..... 30/527, 530, 531, 30/79, 80, 532

(56) References Cited

U.S. PATENT DOCUMENTS 3,740,541 A * 6/1973 Conradt ..... 362/146
3,740,841 A * 6/1973 Risher ..... 30/63
4,026,016 A 5/1977 Nissen
5,056,222 A 10/1991 Miller et al.
5,074,042 A 12/1991 Althaus et al.
5,416,974 A 5/1995 Wain
5,813,119 A 9/1998 Ferraro et al.
5,953,824 A 9/1999 Ferraro et al.
6,112,412 A 9/2000 Richard
6,122,826 A 9/2000 Coffin et al.
6,138,361 A 10/2000 Richard et al.
6,295,734 B1 10/2001 Gilder et al.

* cited by examiner

*Primary Examiner*—Douglas D Watts
(74) *Attorney, Agent, or Firm*—Michaud-Duffy Group LLP

(57) ABSTRACT

A razor cartridge is provided that includes a subframe, a frame, and one or more razor blades attached to the frame. The frame includes a cap, a forward end, and a cap end. The frame is mounted on coengaging bearing surfaces on the frame and the subframe to pivot about an imaginary pivot line that is positioned adjacent the cap, above the bearing surfaces, and aft of the cutting edges of the one or more razor blades. The razor cartridge preferably further includes a spring mechanism that acts between the frame and the subframe.

29 Claims, 3 Drawing Sheets

RAZOR CARTRIDGE

This application claims the benefit of and incorporates by reference essential subject matter disclosed in U.S. Provisional Patent Application No. 60/352,805 filed on Jan. 30, 2002.

BACKGROUND OF THE INVENTION

1. Technical Field

This invention relates to shaving devices in general, and to shaving devices that utilize apparatus for biasing one or more razor blades toward the surface being shaved.

2. Background Information

Modern safety razors include a plurality of blades disposed within a cartridge that is pivotally or rigidly mounted on a handle. Some safety razors have a disposable cartridge for use with a reusable handle, while others have a handle and cartridge that are combined into a unitary disposable. Although a variety of razor cartridge configurations exist, most include a frame made of a rigid plastic that includes a seat and a cap. Cartridges often include a guard disposed forward of the blades. The guard and the cap orient the position of the person's skin relative to the blades to optimize the shaving action of the blade. Some cartridges include a comfort strip comprised of shaving aids (e.g., lubricating agents, drag reducing agents, depilatory agents, cleaning agents, medicinal agents, etc.) to enhance the shaving process. The terms "forward" and "aft", as used herein, define relative position between features of the safety razor (i.e., razor assembly). A feature "forward" of the razor blades, for example, is positioned so that the surface to be shaved encounters the feature before it encounters the razor blades, if the razor assembly is being stroked in its intended cutting direction (e.g., the guard is forward of the razor blades). A feature "aft" of the razor blades is positioned so that the surface to be shaved encounters the feature after it encounters the razor blades, if the razor assembly is being stroked in its intended cutting direction (e.g., the cap is disposed aft of the razor blades).

The comfort and performance provided by a particular razor cartridge are critical to the commercial success of the razor. Improvements that benefit razor comfort, performance, and ease of use, however significant or subtle, can have a decided impact on the commercial success of a razor. For example, most razors include a guard bar to orient the skin to be shaved in a favorable position for the one or more razors disposed aft of the guard. With force applied by the user, the guard bar draws the skin taut to optimize the orientation of the skin relative to the cutting edges of the one or more razor blades. With most presently available razor cartridges, however, the normal force that is desirable to draw the skin taut can also be undesirable if applied too strongly. Excessive force will put the cutting edges of the razor blades too close to the skin and thereby increase the chance the skin will be cut or irritated.

What is needed, therefore, is a razor cartridge that can be used safely for a large range of normal forces applied by the user.

DISCLOSURE OF THE INVENTION

It is, therefore, an object of the present invention to provide a razor cartridge that can be used safely for a large range of normal forces applied by the user.

According to the present invention, a razor cartridge is provided that includes a subframe, a frame, and one or more razor blades. The frame includes a cap, a forward end, and a cap end. The one or more razor blades are attached to the frame. The frame is moveably mounted on the subframe to pivot relative to the subframe about an imaginary pivot line that is positioned adjacent the cap and aft of the cutting edges of the one or more razor blades. The razor cartridge preferably further includes a spring mechanism that acts between the frame and the subframe.

An advantage of the present invention stems from the ability of the razor blades attached to the frame to change their orientation relative to the shave plane. Rotation of the frame and attached razor blades away from the shave plane decreases the angle between the razor blades and the shave plane and thereby decreases the potential for undesirable interaction between the razor blades and the surface to be shaved.

Another advantage of the present cartridge is the safety provided by the spring-loaded razor blades. Because the amount of engagement is a function of the spring force rather than the normal force applied by the user, the user is protected from an errant excessive force stroke.

Another advantage is that the user can apply substantial normal force to the guard (i.e., or to the surface to be shaved via the guard) without the same force being applied to the razor blades. The guard helps to draw the skin taut and thereby provide an optimal surface orientation relative to the cutting edges. Hence, considerable force can be applied to enable the guard to draw the skin taut without the undesirable consequence of excessively engaging the skin with the razor blade cutting edges.

These and other objects, features, and advantages of the present invention will become apparent in light of the detailed description of the present invention.

DETAILED DESCRIPTION OF THE INVENTION

Now referring to FIGS. 1–4, the present invention razor assembly 10 includes a razor cartridge 12 and a handle 14. In some instances, the handle 14 and cartridge 12 are assembled in a manner wherein disassembly of the cartridge 12 from the handle 14 during regular use is not intended (i.e., a unitary disposable razor assembly). In other instances, the cartridge 12 is replaceable and is therefore selectively detachable from the handle 14.

Figure 1:
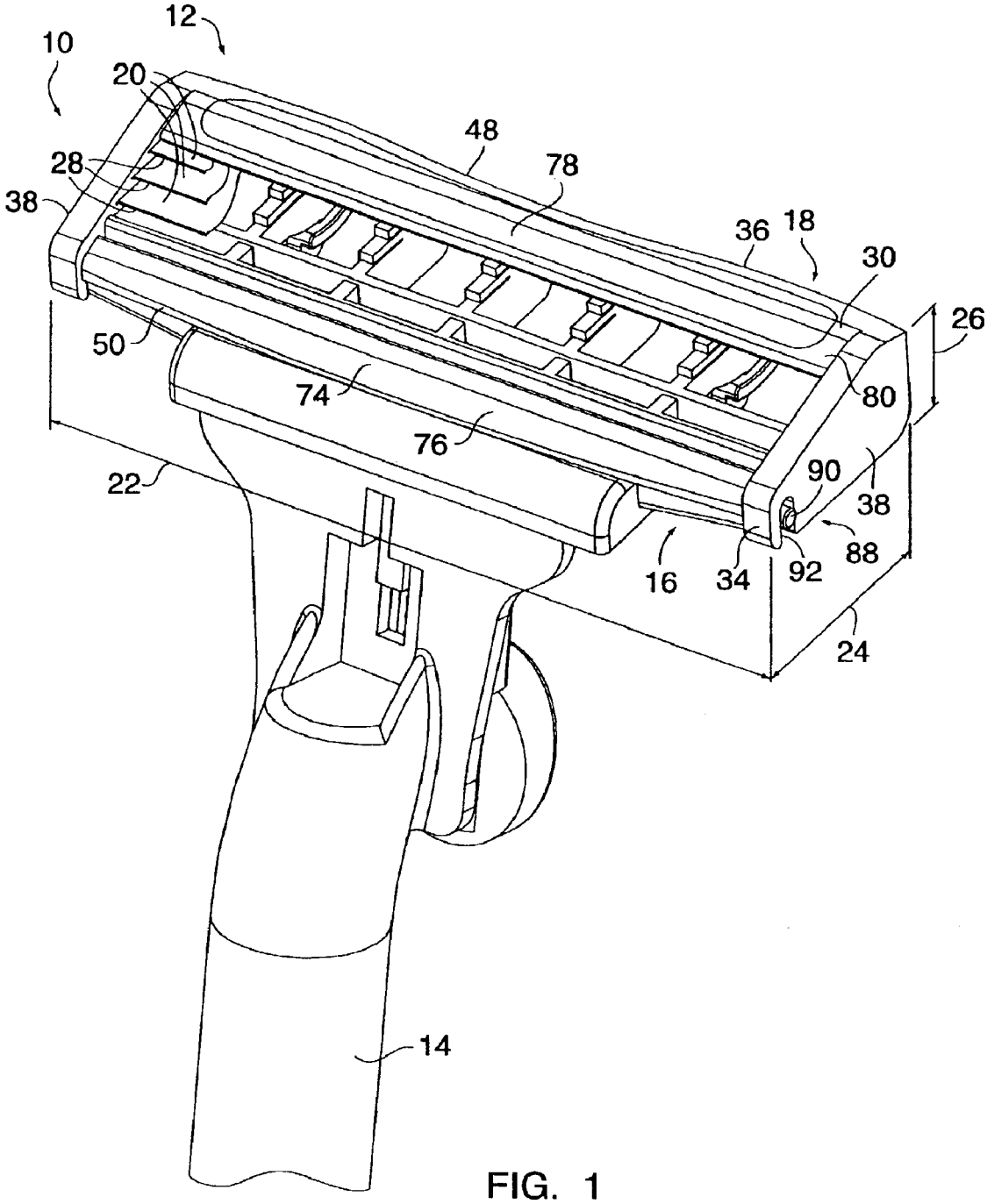
FIG. 1 is a perspective view of a present invention razor assembly.
Figure 2:
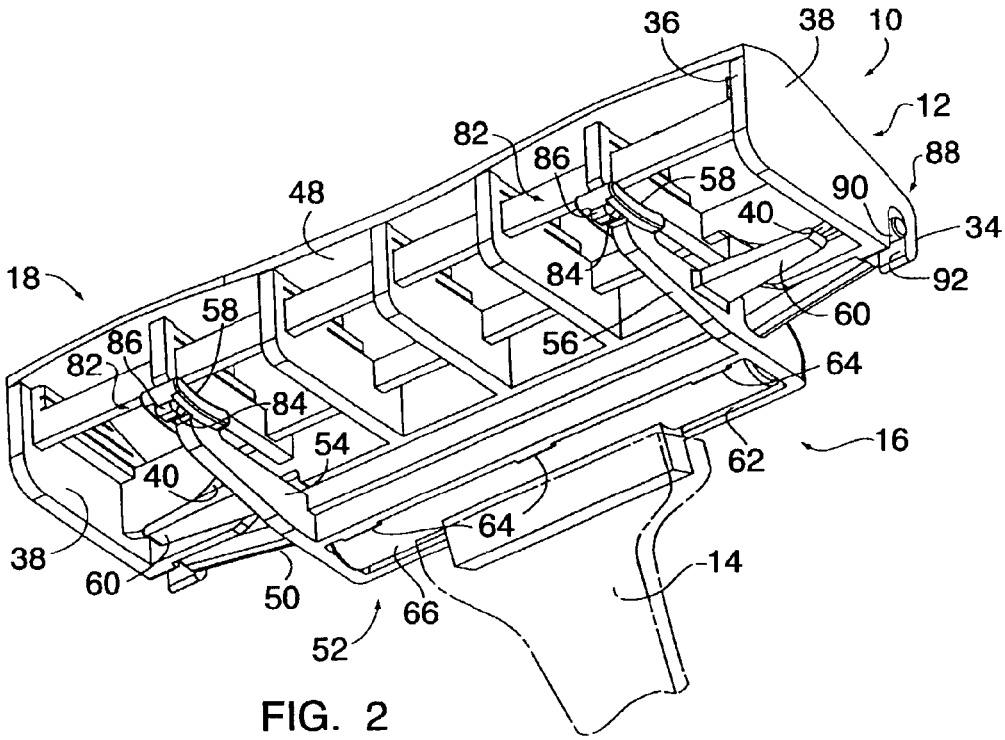
FIG. 2 is a perspective view of the razor cartridge including a handle pivot member.
Figure 3:
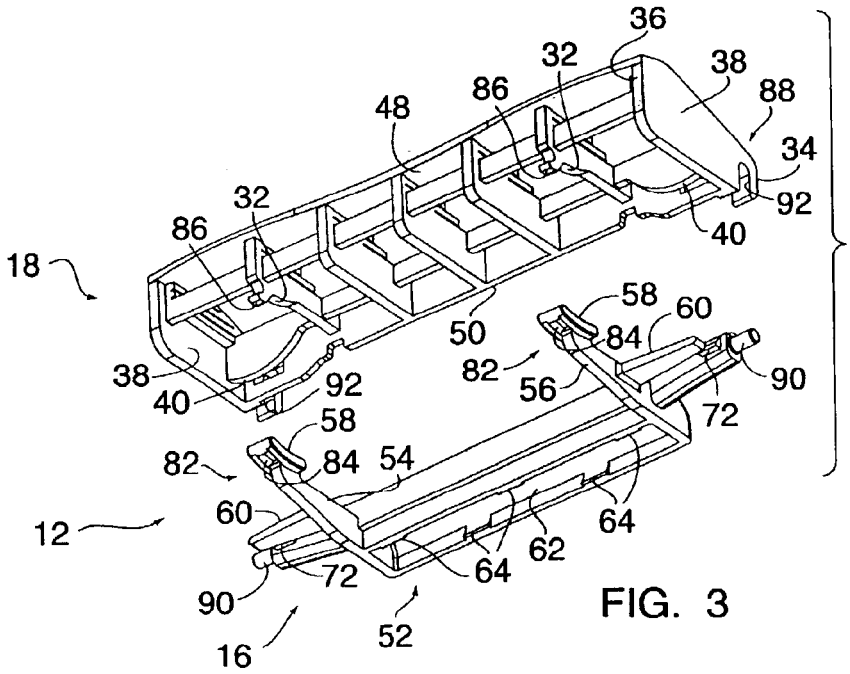
FIG. 3 is an exploded perspective view of the razor cartridge without the handle pivot member shown in FIG. 2.
Figure 4:
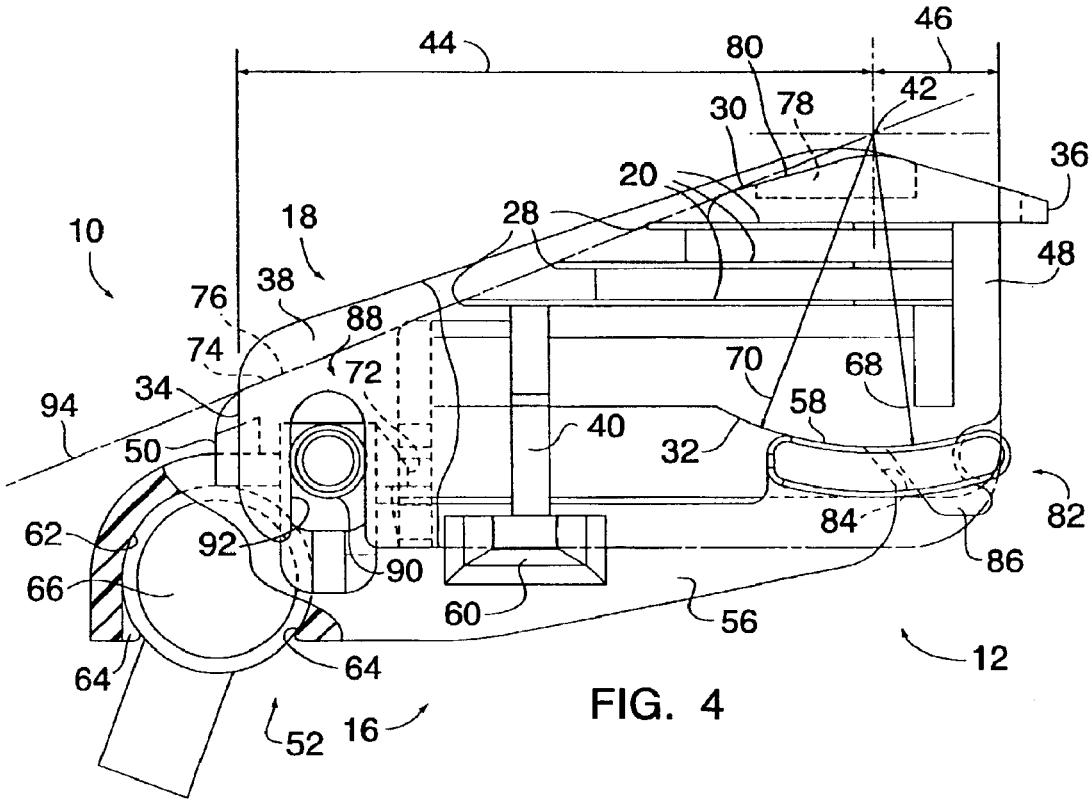
FIG. 4 is a side view of a portion of the razor assembly.

Now referring to FIGS. 2–4, the razor cartridge 12 includes a subframe 16, a frame 18, and one or more razor blades 20, and can be described as having a length 22, a width 24, and a height 26 (see FIG. 1). The one or more razor blades 20, each of which has a lengthwise-extending cutting edge 28, are attached to the frame 18. The frame 18 includes a cap 30, a pair of frame bearing surfaces 32, a forward end 34, a cap end 36, a pair of side panels 38, and a pair of spring tabs 40. The frame 18 is movably mounted on the subframe 16 to pivot relative to the subframe about an imaginary pivot line 42 (shown in FIG. 4 extending into the page) that is positioned adjacent the cap 30, above the frame bearing surface 32, and aft of the cutting edges 28 of the one or more razor blades 20. In relative terms, the pivot line 42 can be described as being positioned a first distance 44 away from the forward end 34 of the frame 18 and a second distance 46 away from the cap end 36 of the frame 18. The first distance 44 is greater than the second distance 46. The cartridge 12 includes an aft end 48 and a forward end 50.

The subframe 16 includes a connector 52 for connecting the handle 14 to the subframe 16, a first rail 54, a second rail 56, a pair of subframe bearing surfaces 58, and a pair of spring members 60. Depending on the application, the connector 52 for connecting the handle 14 can rigidly connect the handle 14 to the subframe 16 or pivotally connect the handle 14 to the subframe 16. In the exemplary embodiment shown in FIGS. 2 and 3, the connector 52 includes a pivot socket 62 and a plurality of clips 64 positioned along the forward end 50 of the cartridge 12. A pivot member 66 (see FIGS. 2 and 4) attached to the handle 14 is received within the pivot socket 62 and held in place by the clips 64. The pivot member 66 and the pivot socket 62 together permit pivotal movement between the handle 14 and the cartridge 12. Other pivot-type connectors can be used alternatively. One subframe bearing surface 58 is attached to each rail 54,56, positioned proximate the aft end 48 of the cartridge 12. The subframe bearing surfaces 58 support the frame 18 and provide a surface on which the frame 18 can slidably move relative to the subframe 16. In the exemplary embodiment shown in FIGS. 2–4, the subframe bearing surfaces 58 are arcuately shaped, having a radius 68 equal to the normal distance between each subframe bearing surface 58 and the pivot line 42. The frame bearing surfaces 32 are spaced apart from one another by a distance sufficient to align them with the subframe bearing surfaces 58. The frame bearing surfaces 32 are shaped to mate with the subframe bearing surfaces 58. In the embodiment shown in FIGS. 2–4, the frame bearing surfaces 32 are arcuately shaped, having a radius 70 equal to the normal distance between each frame bearing surface 32 and the pivot line 42.

One spring member 60 is attached to each rail 54,56 on opposite sides of the subframe 16. Each spring member 60 extends out from the respective rail 54,56 as a cantilever. The spring rate of each spring member 60 is a function of the material of the spring member, the cross-sectional area and geometry of the spring member, and the distance out from the subframe 16 that the frame 18 contacts the spring member 60. The spring rate of each spring member 60 can be altered to suit the application at hand. Although the cantilever spring members 60 represent a preferred embodiment, alternative spring mechanisms can be used. A spring tab 40 is attached to the frame 18 on each side of the cartridge 12 at a position that aligns with the spring member 60 on that side of the cartridge 12. The spring tabs 40 are arcuately shaped to provide a preferred contact surface for interaction with the spring members 60.

In the embodiment shown in FIG. 1, a guard 74 having an exterior surface 76 is attached to the subframe 16 and a shaving aid strip 78 is attached to the cap 30. A variety of guards 74 can be used with the present invention. Guards are well known in the art and will therefore not be discussed further here other than to say the present invention is not limited to being used with any particular type of guard. The guard 74 is positioned forward of the one or more razor blades 20, and the frame 18 is pivotally mounted relative to the guard 74. The cap 30 is positioned aft of the one or more razor blades 20. The cap 30 includes an exterior surface 80, and the shaving aid strip is substantially coplanar with the exterior surface 80 of the cap 30 prior to use. The shaving aid strip 78 can include one or more of a variety of constituent materials such as lubricating agents, drag reducing agents, depilatory agents, cleaning agents, medicinal agents, etc., and is not limited to any single material or combination of materials.

Referring to FIG. 3, the cartridge 12 preferably further includes a mechanism 82 for attaching the frame 18 to the subframe 16. In the embodiment shown in FIGS. 3 and 4, the mechanism 82 includes an aperture 84 disposed in each subframe bearing surface 58 and a tab 86 extending out from each frame bearing surface 32. The apertures 84, which receive the tabs 86, are larger than the tabs 86 to permit movement of each tab 86 within the respective aperture 84. The tabs 86 are preferably hook-shaped to prevent unintended disassembly between the frame 18 and the subframe 16. The attaching mechanism 83 further includes a retaining tab 73 on each side of the frame 18 for engaging the subframe 16 within a respectively associated opening 73 in the subframe. The retaining tabs 72 cooperate with the tabs 86 to attach the frame 18 to the subframe 16 for limited movement relative to the subframe. Other type mechanisms for attaching the frame 18 to the subframe 16 may be used alternatively.

The cartridge 12 preferably further includes a guide mechanism 88 for guiding motion of the frame 18 relative to the subframe 16. In the embodiment shown in FIG. 3, the guide mechanism 88 includes a post 90 extending out from each rail 54,56 on opposite sides of the subframe 16. The guide mechanism 88 further includes a pair of slots 92 disposed in the side panels 38 of the frame 18, positioned to align with the posts 90, and arcuately shaped to accommodate the pivotal travel of the frame 18 relative to the subframe 16.

Referring to FIGS. 1–4 in the operation of the razor assembly 10, the surface to be shaved is typically disposed contiguous with a "shave" plane 94 that extends tangentially between the exterior surface 76 of the guard 74 and the exterior surface 80 of the cap 30, and extends across the length of the cartridge 12. With no load, or less than a minimum predetermined load, applied to the frame 18 by the user in a direction normal to the shave plane 94, the cutting edges 28 of the one or more razor blades 20 intersect, or are adjacent, the shave plane 94. The frame 18 and attached razor blades 20 are supported in this position by the spring members 60 in contact with the spring tabs 40 and the frame bearing surfaces 32 in slidable contact with the subframe bearing surfaces 58. In this position the frame 18 may be unbiased by the spring members 60 or the spring members 60 may bias the frame 18 against a physical stop or stops, such as the retaining tabs 72, attached to the subframe 16. During operation of the razor assembly 10, the user applies a normal force to the razor cartridge 12 and that force is transmitted through the spring tabs 40 to the spring members 60. If the normal force exceeds the predetermined minimum load, the spring members 60 deflect and the frame 18 pivots about the pivot line 42. The pivotal movement is evident by relative motion between the frame bearing surfaces 32 and the subframe bearing surfaces 58, which are in slidable contact with one another. As a result of the pivotal movement of the frame 18, the razor blade cutting edges 28 rotate away from the shave plane 94. The surface to be shaved stays in contact with the razor blade cutting edges 28, and consequently crosses the shave plane. In this state, the force applying the razor blade cutting edges 28 against the surface to be shaved is a function of the spring force applied by the spring members 60 rather than the normal force applied by the user. The surface in contact with the guard 74 and the cap 30, however, is subject to the normal force applied by the user.

Accordingly, one of the advantages of the present razor cartridge 12 is the safety provided by the spring-loaded razor blades 20. Because the amount of engagement is a function of the spring force rather than the normal force, the user is protected from an errant excessive force stroke. Another advantage is that the user still gets the benefit of the normal force applied to the guard 74. The guard 74 helps to draw the skin taut and thereby provide an optimal surface orientation relative to the cutting edges 28. With the present invention, considerable force can be applied to the guard 74 to draw the skin taut without the undesirable consequence of excessively engaging the skin with the cutting edges 28.

Although this invention has been shown and described with respect to the detailed embodiments thereof, it will be understood by those skilled in the art that various changes in form and detail thereof may be made without departing from the spirit and scope of the invention.

What is claimed is:

1. A razor cartridge, comprising:

a subframe;

a frame having a cap, a forward end, and a cap end;

one or more razor blades attached to the frame, wherein each razor blade has a cutting edge;

wherein the frame is mounted on coengaging bearing surfaces on the subframe and the frame to pivot relative to the subframe and about an imaginary pivot line that is positioned adjacent the cap, above the bearing surfaces and aft of the cutting edges of the one or more razor blades.

2. The razor cartridge of claim 1, wherein the forward end of the frame is separated from the pivot line by a first distance and the cap end of the frame is separated from the pivot line by a second distance, and the first distance is greater than the second distance.

3. The razor cartridge of claim 2, further comprising a guard attached to the subframe.

4. The razor cartridge of claim 3, wherein the subframe comprises one or more spring members that act on the frame during at least a portion of a rotational path of the frame relative to the subframe.

5. The razor cartridge of claim 4, wherein the one or more spring members are cantilevered.

6. The razor cartridge of claim 4, wherein the subframe further comprises one or more subframe bearing surfaces; and wherein the frame further comprises one or more frame bearing surfaces; and wherein the one or more subframe bearing surfaces and the one or more frame bearing surfaces are in slidable contact with each other.

7. The razor cartridge of claim 6, wherein the one or more subframe bearing surfaces and the one or more frame bearing surfaces have mating arcuate shapes.

8. The razor cartridge of claim 7, wherein the one or more subframe bearing surfaces each have a radius equal to the normal distance between the pivot line and the one or more subframe bearing surfaces, and the one or more frame bearing surfaces each have a radius equal to the normal distance between the pivot line and the one or more frame bearing surfaces.

9. The razor cartridge of claim 7, further comprising a guide for guiding the frame relative to the subframe.

10. The razor cartridge of claim 9, wherein the subframe further comprises a connector for connecting the razor cartridge to a handle.

11. The razor cartridge of claim 10, wherein the connector pivotally connects the handle to the razor cartridge.

12. The razor cartridge of claim 6, further comprising a mechanism for attaching the frame to subframe.

13. The razor cartridge of claim 12, wherein the mechanism for attaching the frame to the subframe includes an aperture disposed in at least one of the one or more subframe bearing surfaces, and a tab extending out from at least one of the one or more frame bearing surfaces;

wherein the tab aligns with and is received within the aperture to prevent unintended disassembly between the frame and the subframe.

14. The razor cartridge of claim 1, wherein the subframe comprises one or more spring members that act on the frame during at least a portion of a rotational path of the frame relative to the subframe.

15. The razor cartridge of claim 14, wherein the one or more spring members are cantilevered.

16. The razor cartridge of claim 14, wherein the subframe further comprises one or more subframe bearing surfaces; and wherein the frame further comprises one or more frame bearing surfaces; and wherein the one or more subframe bearing surfaces and the one or more frame bearing surfaces are in slidable contact with each other.

17. The razor cartridge of claim 1, further comprising a guard having an exterior surface attached to the subframe, wherein the frame, which is pivotally mounted on the subframe, is pivotable relative to the guard.

18. The razor cartridge of claim 17, further comprising a shaving aid strip attached to the cap.

19. A razor cartridge, comprising:

a subframe;

a guard having an exterior surface is attached to the subframe;

a frame having a forward end, a cap end, and a cap that has an exterior surface;

one or more razor blades attached to the frame, wherein each of the one or more razor blades has a cutting edge;

wherein a shave plane tangentially intersects the exterior surface of the cap and the exterior surface of the guard, and the shave plane extends across a length of the cartridge; and wherein the frame is mounted for movement on the subframe to pivot about an imaginary pivot line positioned proximate the cap and the shave plane and aft of the cutting edge of each of the one or more razor blades to permit the cutting edge of each of the one or more razor blades to selectively rotate toward and away from the shave plane.

20. A razor cartridge for shaving a surface, comprising:

a subframe defining a connector for pivotally connecting the cartridge to a handle;

one or more razor blades, each having a cutting edge;

a spring mounted frame for supporting the one or more razor blades; and a guard;

wherein a spring force applied by the spring mounted frame maintains the one or more razor blades in contact with the surface, and a normal force applied by a user maintains the guard in contact with the surface.

21. A razor assembly, comprising:

a razor cartridge that includes:

a subframe;

a frame having a cap, a forward end, and a cap end; and one or more razor blades attached to the frame, wherein each razor blade has a cutting edge;

wherein the frame is mounted on bearing surfaces on the subframe to pivot about an imaginary pivot line that is positioned adjacent the cap and aft of the cutting edges of the one or more razor blades; and a handle.

22. The razor assembly of claim 21, wherein the razor cartridge is selectively detachable from the handle.

23. The razor assembly of claim 22, wherein the razor cartridge further includes a guard attached to the subframe.

24. The razor assembly of claim 23, wherein the subframe comprises one or more spring members that act on the frame during at least a portion of a rotational path of the frame relative to the subframe.

25. The razor assembly of claim 24, wherein the subframe further comprises one or more subframe bearing surfaces; and wherein the frame further comprises one or more frame bearing surfaces; and wherein the one or more subframe bearing surfaces and the one or more frame bearing surfaces are in slidable contact with each other.

26. The razor assembly of claim 25, wherein the one or more subframe bearing surfaces and the one or more frame bearing surfaces have mating arcuate shapes.

27. The razor assembly of claim 22, wherein the razor cartridge further includes a guide for guiding the frame relative to the subframe.

28. The razor cartridge of claim 20, wherein the frame is pivotally mounted on the subfame.

29. The razor cartridge of claim 13, wherein the mechanism for attaching the frame to the subfame includes a retaining tab carried by the subframe for engagement with the frame.

* * * * *

UNITED STATES PATENT AND TRADEMARK OFFICE

CERTIFICATE OF CORRECTION

PATENT NO. : 6,935,032 B2
DATED : August 30, 2005
INVENTOR(S) : Thomas A. Follo

It is certified that error appears in the above-identified patent and that said Letters Patent is hereby corrected as shown below:

Column 8,
Line 14, after "mounted on the", please delete "subfame" and substitute -- subframe --.
Line 16, after "frame to the", please delete "subfame" and substitute -- subframe --.

Signed and Sealed this

Eighteenth Day of October, 2005

JON W. DUDAS
*Director of the United States Patent and Trademark Office*